United States Patent [19]

Nelson

[11] Patent Number: 4,545,850

[45] Date of Patent: Oct. 8, 1985

[54] REGENERATIVE COPPER ETCHING PROCESS AND SOLUTION

[75] Inventor: Norvell J. Nelson, Palo Alto, Calif.

[73] Assignee: Psi Star, Hayward, Calif.

[21] Appl. No.: 642,150

[22] Filed: Aug. 20, 1984

[51] Int. Cl.[4] ..... C23F 1/00; B44C 1/22; C03C 15/00

[52] U.S. Cl. ..... 156/642; 156/666; 252/79.2

[58] Field of Search ..... 156/642, 656, 666, 345; 134/10, 13; 75/101 R; 252/79.2

[56] References Cited

U.S. PATENT DOCUMENTS 2,172,171 9/1939 Meyer et al. ..... 156/666 X
4,482,425 11/1984 Battey ..... 156/637

*Primary Examiner*—William A. Powell
*Attorney, Agent, or Firm*—Flehr, Hohbach, Test, Albritton & Herbert

[57] ABSTRACT

Process and solution for etching copper and other metals, wherein the etching solution is regenerated and the copper or other metal is recovered in a relatively pure and useful form. The metal is contacted with an aqueous solution of nitric acid to dissolve the metal and form a nitrate of the metal, and sulfuric acid is added to the solution to convert the nitrate to nitric acid and a precipitate of the metal.

4 Claims, No Drawings

REGENERATIVE COPPER ETCHING PROCESS AND SOLUTION

This invention pertains generally to the etching of metals such as copper foil on printed circuit boards, and more particularly to a regenerative process and solution in which the etching solution is replenished as the metal is removed.

U.S. Pat. No. 4,497,687 (Ser. No. 563,683, filed Dec. 20, 1983) describes an aqueous process for etching copper and other metals. This process consumes nitric acid and produces copper nitrate and water according to the following stoichiometric relationship:

$$3Cu + 8HNO_3 \rightarrow 3Cu(NO_3)_2 + 2NO + 4H_2O \quad (1)$$

In this process, considerable solution growth can be expected, especially if nitric acid is added on a continuous basis to maintain a constant etch rate. In such an operation, periodic removal of the copper nitrate and water produced by the reaction is required, as well as replenishment of the nitric acid. The nitric oxide produced by the reaction does not add to the solution growth since it separates as a gas and is easily removed by an exhaust gas scrubber.

In large scale applications, it is possible to regenerate the etching solution with an electrochemical process. The solution can be directly electrolyzed to remove copper as metal and to regenerate the amount of nitric acid which is tied up as a counter ion to the dissolved copper. The dissolved copper is removed at the cathode according to reaction (2) while nitric acid is regenerated at the anode according to reaction (3).

$$Cu^{2+} + 2e^- \rightarrow Cu(0) \quad (2)$$

$$H_2O \rightarrow 2H^+ + 2e^- + 1/2O_2 \quad (3)$$

The combined process, including the nitrate counter ions, is given by reaction (4).

$$H_2O + Cu(NO_3)_2 \rightarrow Cu(0) + 2HNO_3 + 1/2O_2 \quad (4)$$

The only loss in the etching process is that portion of the reacted nitric acid removed as nitric oxide by the exhaust gas scrubber. There is a slight solution gain of 1 water molecule for every 3 copper molecules reacted, as indicated by comparing equations (1) and (4). This amount of water can be expected to be lost through a combination of drag out and evaporation. Thus, in large scale applications, the process can be operated in a virtually closed loop mode. This electrochemical process is relatively expensive and not feasible for anything but large scale applications.

It has now been found that it is possible to regenerate the etching solution chemically to an extent heretofore thought possible only with the electrochemical process described above. Moreover, the chemical regeneration process can be utilized in applications of any size, unlike the electrochemical process.

It is in general an object of the invention to provide a new and improved process and solution for etching copper and other metals.

Another object of the invention is to provide a process and solution of the above character in which the etching solution is regenerated.

These and other objects are achieved in accordance with the invention by adding a controlled amount of sulfuric acid to the nitric acid etching solution. The nitric acid dissolves the metal to form a nitrate of the metal, and the sulfuric acid reacts with the nitrate to form nitric acid and a precipitate of the metal. By this process, the etching solution is regenerated, and the copper or other metal is recovered in a reasonably pure and useful form. In one disclosed embodiment, the etching solution initially contains 3L of copper nitrate and water and 1L of nitric acid (70% concentration), and this solution is regenerated with a solution containing 3 parts sulfuric acid, 2 parts nitric acid and 11 parts water.

In the etching process of the invention, the oxidation of copper takes place according to the relationship set forth in equation (1). Sulfuric acid is added to the etching solution to precipitate dissolved copper as sulfate pentahydrate according to the following relationship:

$$Cu(NO_3)_2 + H_2SO_4 + 5H_2O \rightarrow 2HNO_3 + CuSO_4 \cdot 5H_2O \quad (5)$$

Comparing this equation with equation (4), it will be noted that the chemical regeneration process of equation (5) is equivalent to the electrochemical process of equation (4) with respect to the recovery of nitric acid, but it is far more efficient in water removal. Thus, the chemical regeneration process provides better control of solution growth since it removes more water than the etching process generates. This is important because the reactant nitric acid is typically added as a 70% solution by weight, with a water to acid molecular ratio of 1.5, since this is a standard industrial strength concentration.

The combination of the etching process of equation (1) with the regeneration process of equation (5) provides total control of solution growth. The etching process generates 7 water molecules for every 3 copper molecules dissolved (4 product waters and 3 from the 2 nitric acid molecules added to replace the nitric acid lost via nitric oxide), while the regeneration process removes 15 water molecules for each 3 copper molecules reacted. Consequently, water must be added to maintain the solution volume, but this is a much simpler process than water removal. The overall net reaction is represented by the following equation:

$$3Cu + 3H_2SO_4 + 2HNO_3 + 11H_2O \rightarrow 3CuSO_4 \cdot 5H_2O + 2NO \quad (6)$$

From this equation, it can be seen that a suitable etching solution for use in the combined etching and regeneration process is one in which 3 parts sulfuric acid, 2 parts nitric acid and 11 parts water are consumed.

In one presently preferred embodiment, the initial etching solution contains 3L of copper nitrate in water with a specific gravity of 1.3 to 1.5, with 1.44 preferred, 1L of nitric acid (70% concentration by weight), 200 cc of a 1.1% solution of Dow polymer XD7817.01 (polyacrylamide of high molecular weight) in water, and 6 cc of 3M surfactant FC-135 (a cationic fluorosurfactant). This solution is regenerated after the initial etching of copper by adding a regeneration solution containing 3 parts sulfuric acid, 2 parts nitric acid, and 11 parts water. In addition, the regeneration solution contains enough polymer and surfactant to return these materials to their concentration levels in the initial solution.

EXAMPLE 1

Metallic copper was etched in a solution containing 3L of copper nitrate in water (specific gravity 1.44), 1L of nitric acid (70% concentration), 200 cc of a 1.1% solution of Dow polymer XD7817.01 (a polyacrylamide of high molecular weight) in water, and 6 cc of 3M surfactant FC-135 (a cationic fluorosurfactant). The reaction was allowed to continue until 47 g of copper metal were reacted and added to the solution. Thereafter 22 cc (about 40 g) of sulfuric acid were added to 1L of the used etching solution, and this resulting solution was cooled in an ice-water bath to a solution temperature on the order of about 3°-5° C. During this time, a finely divided blue crystalline material separated from the solution. This material was isolated, oven dried, and weighed; 42.1 g of $CuSO_4$ were obtained. This amounts to about a 63% recovery of the added sulfate. In addition, 16.8 g of copper were removed from solution with a corresponding regeneration of about 34 g of nitric acid.

EXAMPLE 2

In this example, 2L of the used etching solution of Example 1 were given an additional 100 cc of sulfuric acid, which resulted in a temperature rise to 37° C. This solution was allowed to cool slowly. Upon cooling to 32° C., small blue crystals began to settle out. The solution was placed in a cool room overnight where it cooled slowly to 16°-17° C., during which time much solid precipitated. The crystals were isolated and weighed as the deep blue copper sulfate pentahydrate, and 334.5 g of solid were obtained. This amounts to a 71% recovery of the added sulfate. In addition, 85 g of copper were removed from the etching solution along with 120 g of water. Also, 169 g of nitric acid were regenerated in the etching solution.

It is apparent from the foregoing that a new and improved process and solution for etching copper and other metals have been provided. While only certain presently preferred embodiments have been described in detail, as will be apparent to those familiar with the art, certain changes and modifications can be made without departing from the scope of the invention as defined by the following claims.

I claim:

1. In a regenerative process for etching copper, the steps of: contacting the copper with an aqueous solution of nitric acid to dissolve the copper and form copper nitrate, and adding sulfuric acid to the solution to convert the copper nitrate to nitric acid and a copper precipitate.

2. The process of claim 1 wherein the copper is dissolved according to the relationship $$3Cu + 8HNO_3 \rightarrow 3Cu(NO_3)_2 + 2NO + 4H_2O,$$

and the sulfuric acid combines with the copper nitrate according to the relationship $$Cu(NO_3)_2 + H_2SO_4 + 5H_2O \rightarrow 2HNO_3 + CuSO_4 \cdot 5H_2O.$$

3. In a regenerative process for etching a metal, the steps of: contacting the metal with an aqueous solution of nitric acid to dissolve the metal and form a nitrate of the metal, and adding sulfuric acid to the solution to convert the nitrate to nitric acid and a precipitate of the metal.

4. A regeneration solution for use in etching copper and other metals with nitric acid, comprising 3 parts sulfuric acid, 2 parts nitric acid and 11 parts water.

* * * * *